US006012167A

United States Patent [19]

De Rosa et al.

[11] Patent Number: 6,012,167

[45] Date of Patent: Jan. 11, 2000

[54] GARMENT HAVING ROPE-CARRYING POCKET

[75] Inventors: Steven C. De Rosa, Southtown, N.Y.; William L. Grilliot; Mary I. Grilliot, both of Dayton, Ohio

[73] Assignees: W. M. Grilliot; M. I. Grilliot; Norcross Safety Products, L.L.C., all of Oak Brook, Ill.

[21] Appl. No.: 09/076,954

[22] Filed: May 13, 1998

[51] Int. Cl.[7] ..... A41D 1/02; A41D 13/00

[52] U.S. Cl. ..... 2/94; 2/108; 2/247; 2/253

[58] Field of Search ..... 2/93, 94, 247, 2/81, 85, 102, 108, 227, 79, 250, 253, 254

[56] References Cited

U.S. PATENT DOCUMENTS

| | | | |
|---|---|---|---|
| 139,950 | 6/1873 | Garaud | 2/94 |
| 1,448,940 | 3/1923 | Pohlkotte | 2/94 |
| 1,723,214 | 8/1929 | Smith | 2/94 |
| 1,908,156 | 5/1933 | Kalish et al. . | |
| 2,320,783 | 6/1943 | Lee | 2/94 |
| 2,448,804 | 9/1948 | Hutchinson | 2/94 |
| 2,865,025 | 12/1958 | Hennessey | 2/94 |
| 2,873,449 | 2/1959 | Herbert | 2/94 |
| 3,074,074 | 1/1963 | Lovering | 2/94 |
| 3,670,340 | 6/1972 | Walker | 2/93 |
| 4,145,762 | 3/1979 | Wallach | 2/67 |
| 4,161,266 | 7/1979 | Howarth, Jr. | 224/215 |
| 4,164,792 | 8/1979 | Ito | 2/108 |
| 4,302,847 | 12/1981 | Miles | 2/2 |
| 4,817,210 | 4/1989 | Aldridge et al. | 2/81 |
| 4,925,070 | 5/1990 | Tulgan | 224/202 |
| 4,955,456 | 9/1990 | Mulkey | 182/3 |
| 5,050,244 | 9/1991 | Kleinman | 2/227 |
| 5,454,744 | 10/1995 | Seiler | 441/109 |
| 5,561,865 | 10/1996 | Fjelstul | 2/227 |
| 5,611,085 | 3/1997 | Rasmussen | 2/102 |

OTHER PUBLICATIONS

From 1998 Catalog 49 of Forestry Products, Inc. of Jackson, Mississippi, front cover and p. 2 only.

*Primary Examiner*—Amy Vanatta
*Attorney, Agent, or Firm*—Rockey, Milnamow & Katz, Ltd.

[57] ABSTRACT

A garment, such as a coat, shirt, or jacket, for a firefighter, a rescue worker, a forestry worker, or another worker having to carry a rope has a back portion and two front portions, each front portion extending from the back portion at one side of the garment. A back pocket extending at least substantially across the back portion, between the sides of the garment, is adapted to carry a rope placed in a zigzag pattern. A front pocket extending at least partially across one of the front portions of the garment communicates with the back pocket, through a slit in the garment, so that a rope carried within the back pocket is removable through the slit and through the front pocket. A front flap overlies the front pocket and the slit. The back pocket is accessible from the interior of the garment and the front pocket is accessible from the exterior of the garment. A strip coacting with the back portion to define the back pocket has an upper edge and a lower edge. The lower edge is affixed to the back portion of the garment, at least substantially across the back portion of the garment, and the upper edge is fastened removably to the back portion of the garment via a hook-and-loop fastener extending at least substantially across the back portion of the garment. A liner of the garment is displaceable to permit access to the back pocket. In an alternative embodiment, which is similar otherwise, the back pocket is an exterior pocket.

8 Claims, 2 Drawing Sheets

FIG. 1
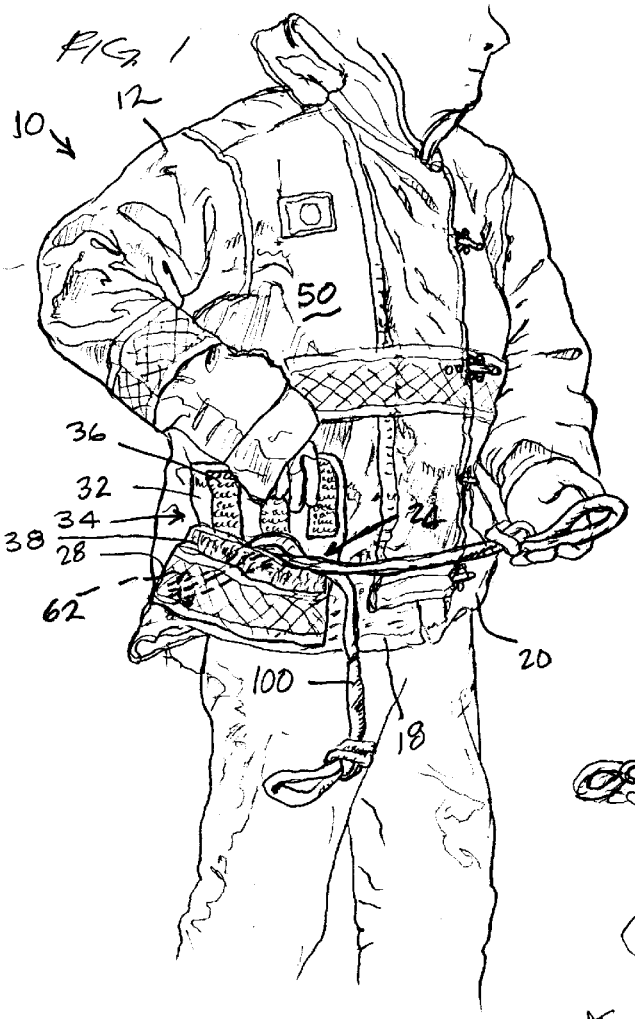
FIG. 2
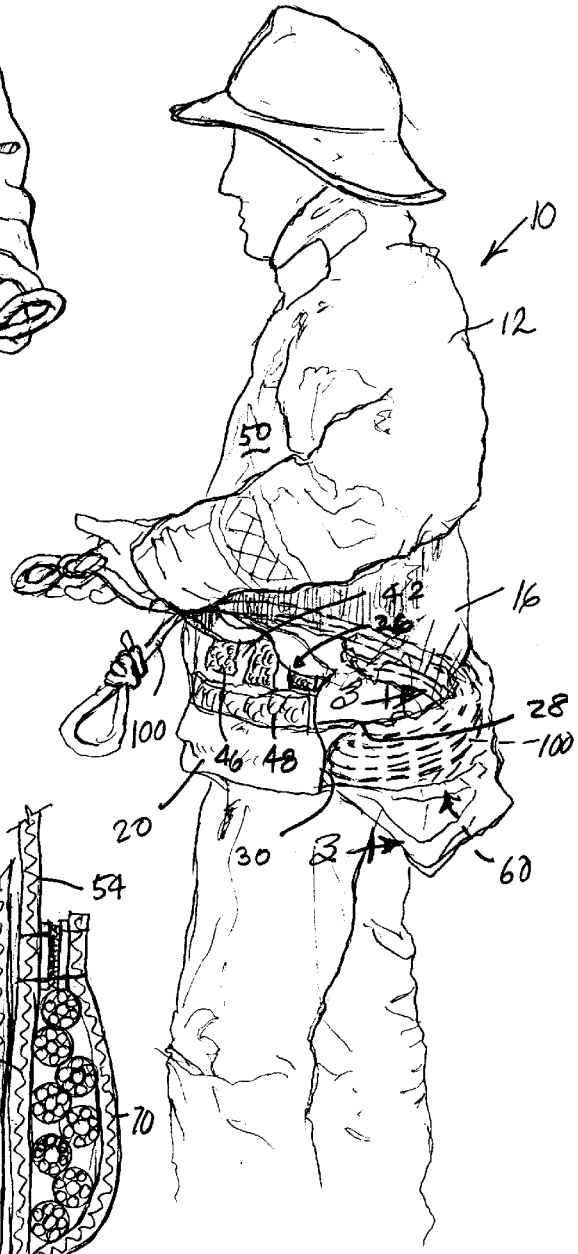
FIG. 3
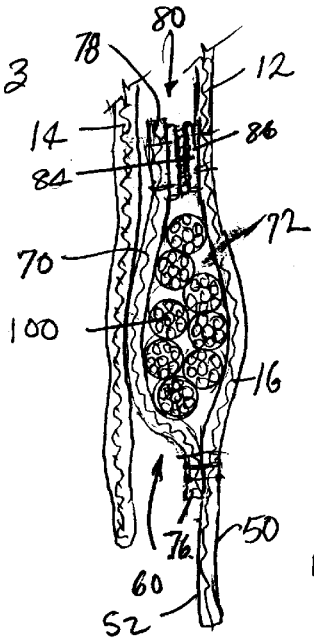
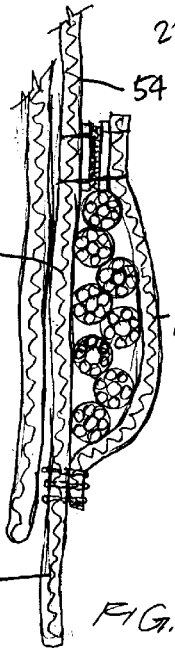
FIG. 3A

GARMENT HAVING ROPE-CARRYING POCKET

FIELD OF THE INVENTION

This invention pertains to improvements in a garment for a firefighter, a rescue worker, a forestry worker, or another worker having to carry a rope. As improved by this invention, the garment has a rope carrying pocket, which enables the firefighter or other worker effectively to carry a bulky, heavy rope without unduly inhibiting mobility or comfort.

BACKGROUND OF THE INVENTION

Commonly, firefighters, rescue workers, and other workers, such as construction workers and forestry workers, are equipped with bulky, heavy ropes, which they must carry in their hands or on their shoulders while walking, climbing, or working. Such ropes tend to imbalance the firefighters or other workers who have to carry such ropes. A need has been recognized, to which this invention is addressed, for a better way for such workers to carry bulky, heavy ropes without becoming unbalanced, while freeing their hands.

SUMMARY OF THE INVENTION

This invention provides an improved garment, such as a coat, shirt, or jacket, for a firefighter, a rescue worker, a forestry worker, or another worker having to carry a rope. The garment is similar to known garments in having a back portion and two front portions with each front portion extending from the back portion at one of the opposite sides of the garment. The garment differs from known garments in having a back pocket extending at least substantially across the back portion, between the opposite sides of the garment. The back pocket is adapted to carry a rope placed in a zigzag pattern distributing the bulk and weight of the rope within the back pocket.

Preferably, the garment is provided with a front pocket extending at least partially across one of the front portions of the garment and the front pocket communicates with the back pocket so that a rope carried within the back pocket is removable through the front pocket. Preferably, moreover, the garment has a front flap extending at least partially across the front portion of the garment. Having a raised position and a lowered position, the front flap overlies the front pocket when in the lowered position. Preferably, the back pocket is accessible from the interior of the garment and garment has a slit, which communicates with the back pocket so that a rope carried within the back pocket is removable through the slit and through the front pocket, if provided.

In a preferred embodiment, the back pocket is defined by a strip coacting with the back portion of the garment. A lower edge of the strip is affixed, as by sewing, gluing, or riveting, to the back portion of the garment, at least substantially across the back portion of the garment. An upper edge of the strip is fastened removably to the back portion of the garment, preferably via a hook-and-loop fastener extending at least substantially across the back portion of the garment. The garment may have a liner, which underlies the strip but which is displaceable to permit access to the back pocket. In the preferred embodiment, moreover, the back pocket is positioned so as to wrap partially around the buttocks of a standing worker wearing the garment.

In an alternative embodiment, the strip is affixed similarly to the back portion of the garment, at an exterior surface of the coacting region. Thus, in the alternative embodiment, the back pocket is an exterior pocket.

These and other objects, features, and advantages of this invention are evident from the following description of a preferred embodiment of this invention, with reference to the accompanying drawings.

BRIEF DESCRIPTION OF THE DRAWINGS

FIGS. 1 and 2 are fragmentary views taken from different perspectives to illustrate a firefighter wearing a garment constituting a preferred embodiment of this invention. As shown, the firefighter is holding a rope pulled partially from a back pocket of the garment, through a front pocket of the garment.

FIG. 3, on a larger scale, is a fragmentary, sectional view of the back pocket containing the rope and of a liner underlying the back pocket, as taken along line 3—3 of FIG. 2, in a direction indicated by arrows.

FIG. 3A is a view similar to FIG. 3 but showing an alternative embodiment, in which the back pocket is an exterior pocket.

DETAILED DESCRIPTION OF THE PREFERRED EMBODIMENT

Figure 4:
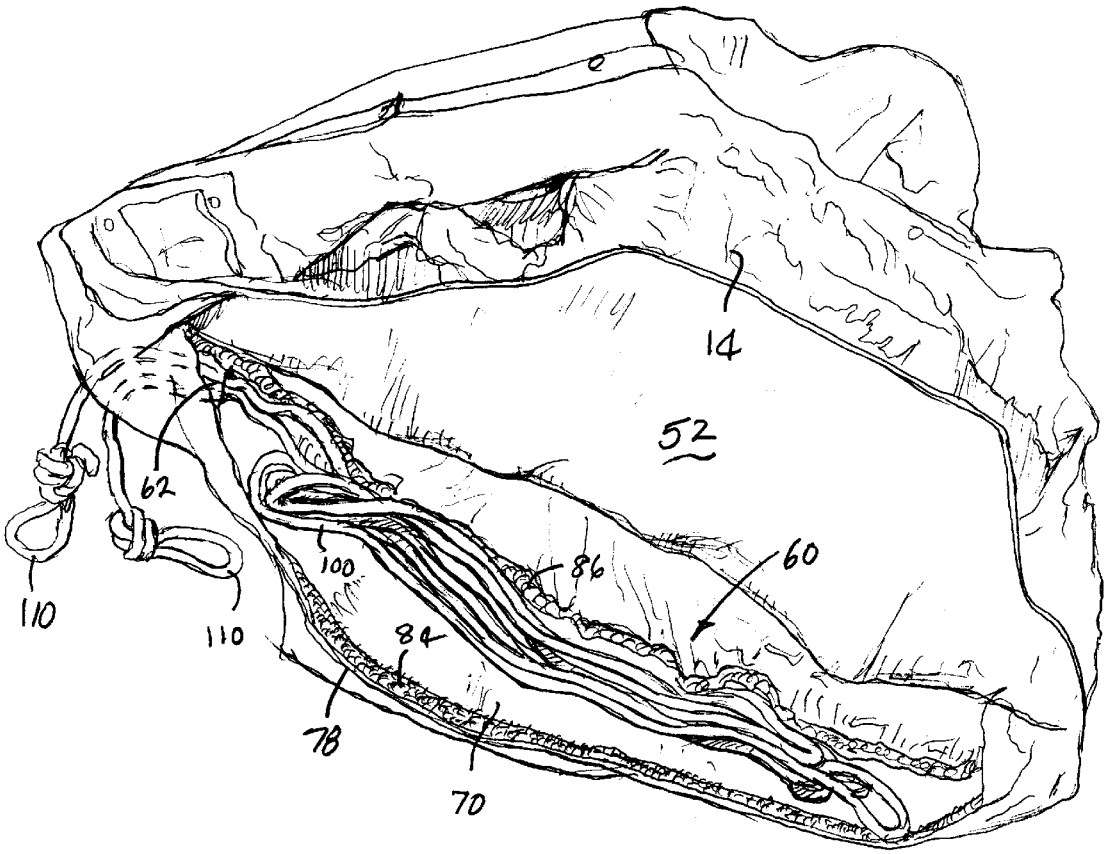
FIGS. 4 and 5, on a similar scale, are fragmentary, perspective views of what is illustrated in FIG. 3, except that the liner is displaced to permit access to the back pocket in FIGS. 4 and 5 and except that the back pocket is illustrated as opened in FIG. 4.
Figure 5:
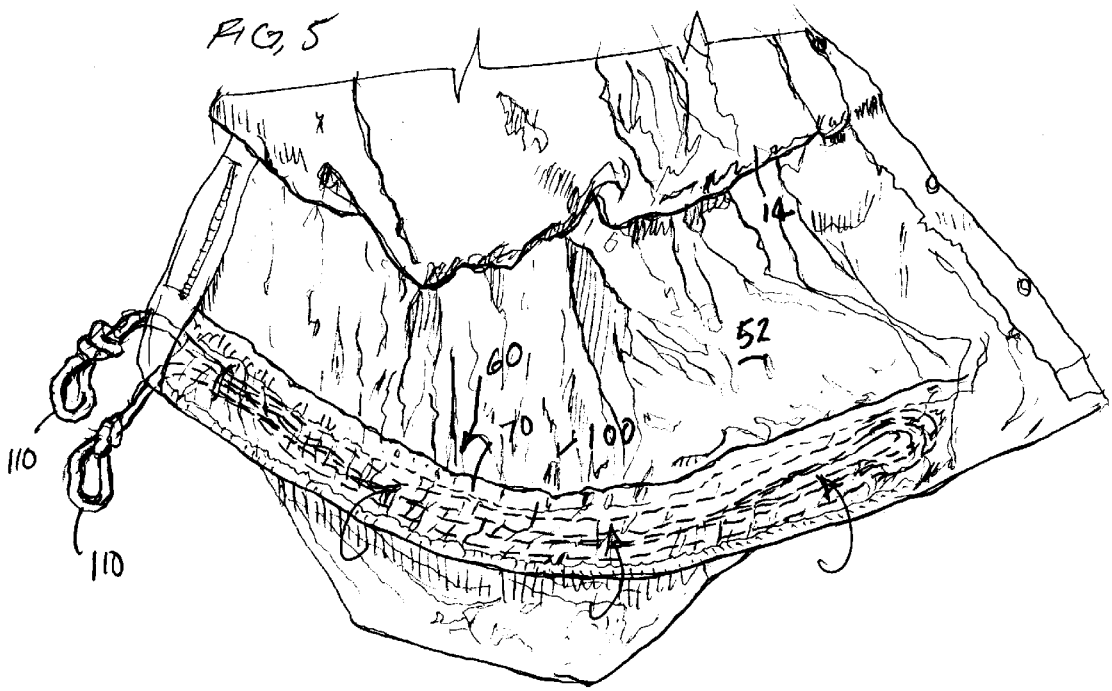

As shown in the drawings, a garment 10 adapted to carry a bulky, heavy rope 100 constitutes a preferred embodiment of this invention. Although the garment 10 is illustrated as being a coat worn by a firefighter, the garment 10 could be also embodied in another garment, such as a shirt or a jacket. Moreover, the garment 10 would be also useful if worn by a rescue worker, a construction worker, a forestry worker, or another worker having to carry such a rope 100.

Except as illustrated and described herein, the garment 10 may be substantially similar to prior garments designed for firefighters and rescue workers and manufactured and sold by Morning Pride Manufacturing, Inc. of Dayton, Ohio. The garment 10 has an outer body 12 cut and sewn from a suitable fabric and an inner liner 14 cut and sewn from a suitable fabric. Although the outer body 12, the inner liner 14, or both may have plural layers, single layers are shown to simplify the drawings. The garment 10 including the outer body 12 has a back portion 16, a right, front portion 18, and a left, front portion 20. Each of the front portions 18, 20, extends from the back portion 16 at one of the opposite sides of the garment 10. The garment 10 has a right, front pocket 24 sewn to the outer body 12, on the right, front portion 18, and a left, front pocket 26 sewn to the outer body 12, on the left, front portion 20. The back edge 28 of the right, front pocket 24 and the back edge 30 of the left, front pocket 26 define the opposite sides of the garment 10.

A right, front flap 32 made from a suitable fabric is sewn to the outer body 12 so as to extend at least partially across the right, front portion 18. Having a raised position and a lowered position, the right, front flap 32 is arranged to be releasably fastened in the lowered position, in which the right, front flap 32 overlies the right, front pocket 24, via a hook-and loop fastener 34 comprising several hook-faced panels 36 sewn to the right, front flap 32 and a loop-faced panel 38 sewn to the right, front pocket 24. A left, front flap 42 made from a suitable fabric is sewn to the outer body 12 so as to extend at least partially across the left, front portion 20. Having a raised position and a lowered position, the left, front flap 42 is arranged to be releasable fastened in the lowered position, in which the left, front flap 42 overlies the left, front pocket 26, via a hook-and loop fastener 44 comprising several hook-faced panels 46 sewn to the left, front flap 42 and a loop-faced panel 48 sewn to the left, front pocket 24. The respective pockets 24, 26, and the respective flaps 32, 42, are sewn to an exterior surface 50 of the outer body 12 of the garment 10.

As improved by this invention, the garment 10 has a back pocket 60 extending at least substantially across the back portion 16, between the back edges 28, 30, of the front pockets 24, 26. Whereas the left, front pocket 26 does not communicate with the back pocket 60, the right, front pocket 24 communicates with the back pocket 60 via a slit 62 in the outer body 12 of the garment 10. The back pocket 60 is defined by a strip 70 of suitable fabric and by a coacting region 72 of the back portion 16 of the garment 10. As illustrated, for comfort and accessibility, the back pocket 60 is disposed so as to wrap partially around the buttocks of a standing worker wearing the garment 10. The inner liner 14 is displaceable, as illustrated in FIG. 4, so as to permit access to the back pocket 60.

A lower edge 76 of the strip 70 is affixed by sewing, as illustrated and preferred, by other fastening means (not shown) such as a series of rivets, or otherwise to the back portion 16 of the garment 10, at an interior surface 52 of the coacting region 72. An upper edge 78 of the strip 70 is fastened removably to the garment 10, at the interior surface 52, via a hook-and-loop fastener 80 comprising a hook-faced panel 84 sewn to the strip 70, along the upper edge 78, and comprising a loop-faced panel 86 sewn to the interior surface 52. The upper edge 78 can be alternatively fastened removably to the garment 10, at the interior surface 52, via other fastening means (not shown) such as one or more zippers (not shown) or a series of snap fasteners or turn-button fasteners.

The back pocket 60 is adapted to carry the rope 100, which can be advantageously placed within the back pocket 60 in a zigzag pattern, as illustrated, so as to distribute the bulk and weight of the rope 100 within the back pocket 60. Desirably, as illustrated, the ends 110 of the rope 100 extend through the slit 62, into the right, front pocket 24, whereby the rope 100 can be freely removed from the back pocket 60, through the slit 62 and through the right, front pocket 24. Moreover, the right, front pocket 24 can be advantageously used to hold fittings (not shown) such as hooks or plates, if fitted on or attached to the ends 110 of the rope 100.

As illustrated in FIG. 3A, an alternative embodiment of this invention is similar to the preferred embodiment illustrated in the other views and described above, except that the strip 70 is affixed similarly to the back portion 16 of the garment 10, at an exterior surface 54 of the coacting region 72. In the alternative embodiment, the back pocket 16 may adjoin the front pockets 24, 26, and may communicate with one of the front pockets 24, 26, through a slit (not shown) similar to the slit 62.

Various modifications can be made in the preferred and alternative embodiments described above without departing from the scope and spirit of this invention.

We claim:

1. A garment for a firefighter, a rescue worker, a forestry worker, or another worker having to carry a rope, the garment having two opposite sides and having a back portion and two front portions, each front portion extending from the back portion at one of the opposite sides, the garment having a back pocket extending at least substantially across the back portion, between the opposite sides, the back pocket being adapted to carry a rope placed in a zigzag pattern distributing the bulk and weight of the rope within the back pocket, the garment having a front pocket extending at least partially across one of the front portions of the garment, the front pocket communicating with the back pocket so that a rope carried within the back pocket is removable through the front pocket, the front pocket of the garment having a front flap extending at least partially across the front portion having the front pocket, the front flap having a raised position and a lowered position and overlying the front pocket when in the lowered position.

2. A garment for a firefighter, a rescue worker, a forestry worker, or another worker having to carry a rope, the garment having two opposite sides and having a back portion and two front portions, each front portion extending from the back portion at one of the opposite sides, the garment having a back pocket extending at least substantially across the back portion, between the opposite sides, the back pocket being adapted to carry a rope placed in a zigzag pattern distributing the bulk and weight of the rope within the back pocket, the garment having an interior and an exterior, the garment having a front pocket extending at least partially across one of the front portions of the garment, the front pocket communicating with the back pocket so that a rope is removable through the front pocket, the back pocket being accessible from the interior of the garment and the front pocket being accessible from the exterior of the garment, the garment having a slit and the back and front pockets communicating through the slit so that a rope carried within the back pocket is removable through the slit and through the front pocket, the front pocket of the garment having a front flap extending at least partially across the front portion having the front pocket, the front flap having a raised portion and a lowered position and overlying the front pocket and the slit when in the lowered position.

3. The garment of claim 1 or claim 2 wherein the back pocket is defined by a strip coacting with the back portion of the garment and having an upper edge and a lower edge, the lower edge being affixed to the back portion of the garment, at least substantially across the back portion of the garment, the upper edge being fastened removably to the back portion of the garment.

4. The garment of claim 3 wherein the upper edge of the strip defining the back pocket is fastened removably to the back portion of the garment via a hook-and-loop fastener extending at least substantially across the back portion of the garment.

5. The garment of claim 3 having a liner underlying the strip defining the back pocket, the liner being displaceable to permit access to the back pocket.

6. The garment of claim 4 having a liner underlying the strip defining the back pocket, the liner being displaceable to permit access to the back pocket.

7. The garment of claim 1 or claim 2 wherein the back pocket is disposed so as to wrap partially around the buttocks of a standing worker wearing the garment.

8. The garment of claim 7 having a liner underlying the strip defining the back pocket, the liner being displaceable to permit access to the back pocket.

* * * * *